United States Patent [19]

Pawlowski

[11] 4,383,612

[45] May 17, 1983

[54] CARTON

[75] Inventor: Thomas D. Pawlowski, Neenah, Wis.

[73] Assignee: James River-Dixie/Northern, Inc., Greenwich, Conn.

[21] Appl. No.: 305,230

[22] Filed: Sep. 24, 1981

[51] Int. Cl.[3] ..... B65D 5/50; B65D 81/00

[52] U.S. Cl. ..... 206/525; 206/45.14; 229/38; 229/39 R

[58] Field of Search ..... 206/525, 45.14, 45.19, 206/45.31, 590; 229/39, 38

[56] References Cited

U.S. PATENT DOCUMENTS

| | | | |
|---|---|---|---|
| 2,971,688 | 2/1961 | Akers | 229/38 |
| 3,018,030 | 1/1962 | Schnee | 229/39 R |
| 3,204,759 | 9/1965 | Palmer | 206/45.31 |
| 3,819,035 | 6/1974 | Jaeschke | 206/45.31 |

*Primary Examiner*—William T. Dixson, Jr.
*Attorney, Agent, or Firm*—William A. Aguele; Harry W. Hargis, III

[57] ABSTRACT

A carton has side and bottom walls of generally rectangular configuration, a pair of dust flaps hinged for closure on opposed side walls, and a pair of closure flaps hinged on opposed walls perpendicular to the first, for closure over the dust flaps. The dust flaps are constructed and arranged to be hinged inwardly of the carton and include cut-out sections that receive neck portions of a dispensing bottle and a rotationally locked dispensing nozzle thereon to hold the nozzle in place and to hold the bottle stationary as against movement about its base which is itself engaged, and held from shifting, by the carton side walls.

10 Claims, 6 Drawing Figures

FIG.1
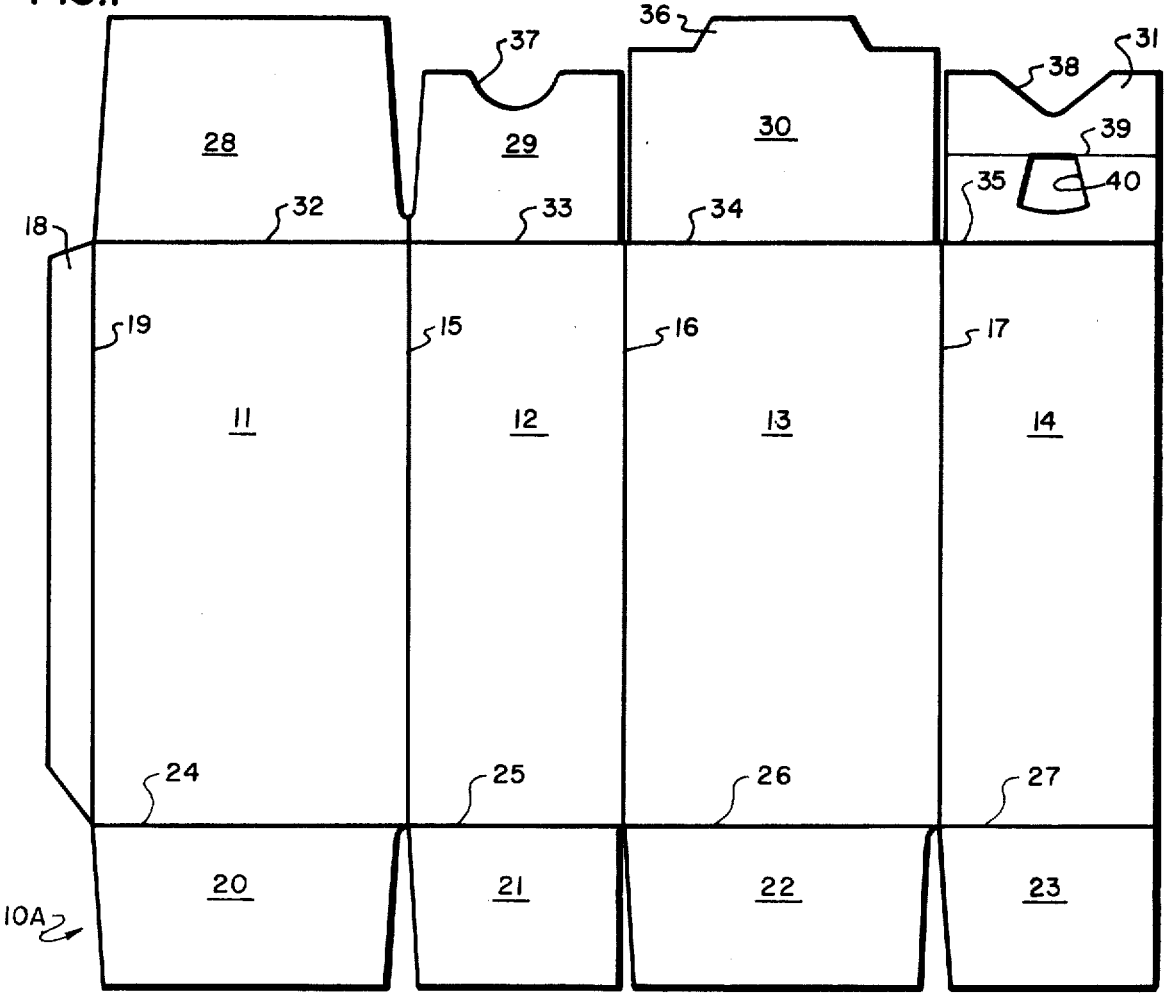
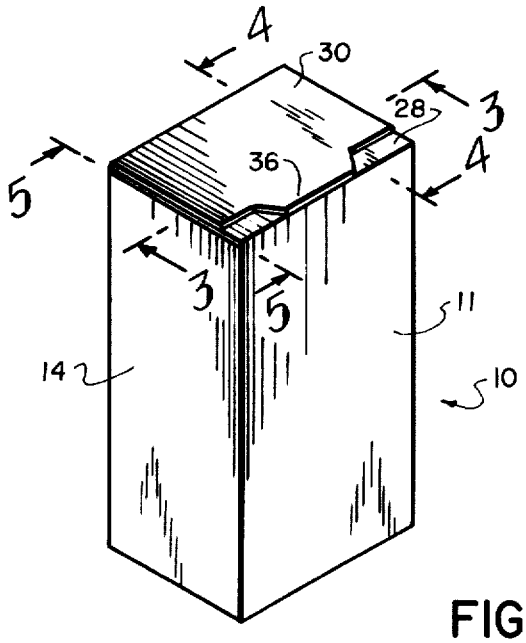
FIG.2

FIG.3
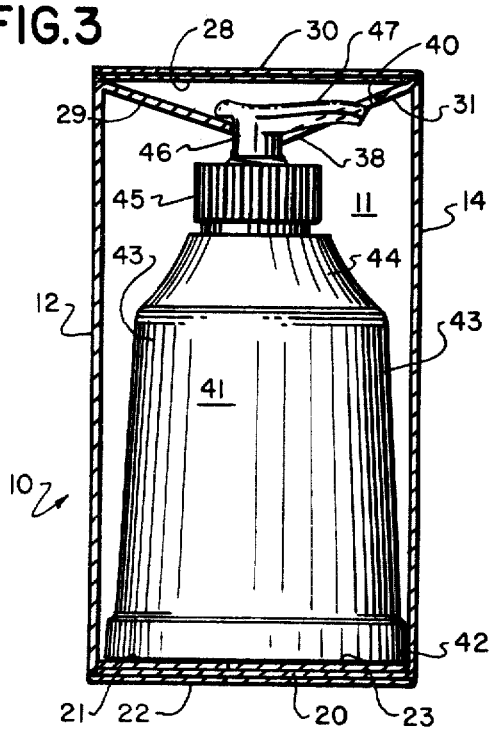
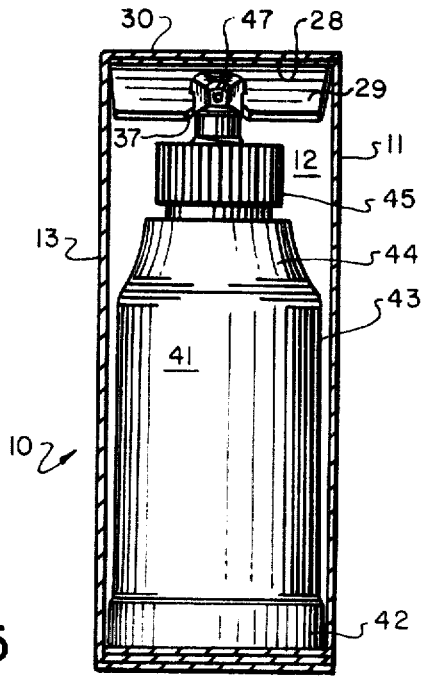
FIG.5
FIG.4
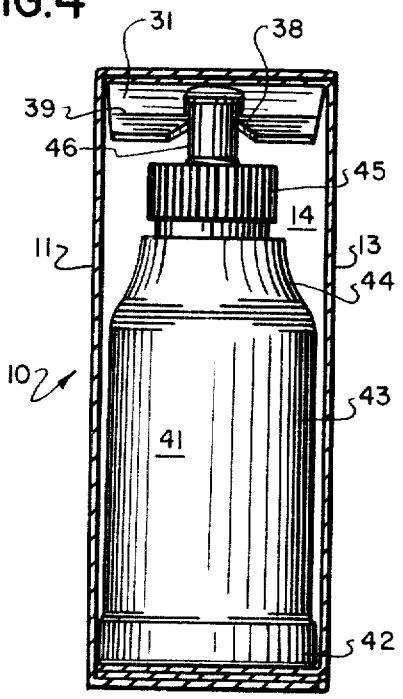
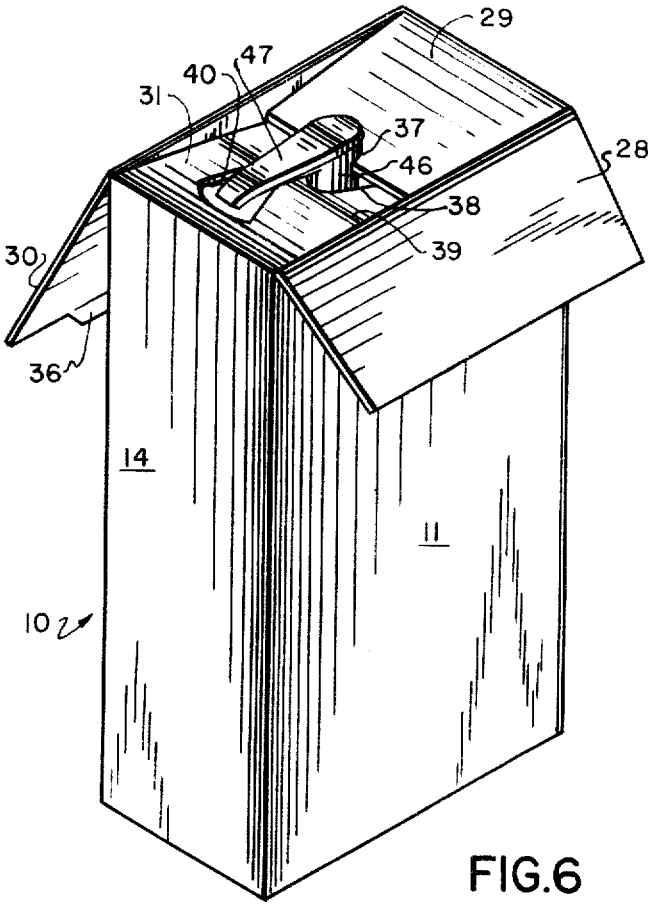
FIG.6

CARTON

BACKGROUND OF THE INVENTION

This invention relates to cartons, and more particularly to cartons for holding bottles provided with rotationally locking dispensing nozzles.

In the shipping and merchandising of bottles provided with rotationally locking dispensing nozzles for liquids, for example soap, care must be taken to ensure that the contents of the bottles are not spilled due to inadvertant rotation and unlocking of the nozzle arising from movements of the bottle relative to the carton or container.

It is a general objective of this invention to provide an improved, relatively inexpensive means for preventing relative movements between a bottle and its carton.

It is a further objective to provide an improved, inexpensive means formed integrally with a carton and cooperatively disposed as respects a contained bottle to prevent its movements relative to the carton.

SUMMARY OF THE INVENTION

In achievement of the foregoing as well as other objectives, the invention contemplates in a carton of the type having side and bottom walls, an opening opposite said bottom wall, and closure means for said opening, said carton being adapted to contain a bottle having a base portion to rest on said bottom wall and be engaged by said carton sidewall, and a neck portion including a rotationally locked dispensing nozzle thereon, the improvement wherein said closure means comprises: a pair of dust flaps hinged for closure inwardly of said opening on opposed side wall portions of said carton, one of said dust flaps including a recess on a free edge portion opposite its hinge positioned and adapted to receive and frictionally engage one side of a bottle neck portion, and the other of said dust flaps including a recess on a free edge portion opposite its hinge positioned and adapted to receive and frictionally engage a side of said bottle neck portion opposite said one side, said other dust flap further including an opening between said recess therein and said hinge, and positioned and adapted to receive said dispensing nozzle and frictionally retain the latter in its rotationally locked position.

The manner in which the foregoing as well as other objectives and advantages of the invention may best be achieved will be more fully understood from the following description, taken in light of the accompanying drawing.

BRIEF DESCRIPTION OF THE DRAWING

FIG. 1 is a plan view of a suitably cut and scored paperboard blank from which there is set up a carton embodying the invention;

FIG. 2 is a perspective view of a carton set up from the blank seen in FIG. 1;

FIG. 3 is a section taken along the line 3—3 in FIG. 2, illustrating a contained bottle and its engagement by elements of the carton;

FIG. 4 is a section taken along the line 4—4 in FIG. 2;

FIG. 5 is a section taken along line 5—5 in FIG. 2; and

FIG. 6 is an enlarged perspective view similar to the view of FIG. 2, with the carton closure flaps in opened position.

DESCRIPTION OF THE PREFERRED EMBODIMENT

With more detailed reference to the drawing, and first to FIG. 1, a paperboard blank 10A includes side wall panels 11, 12, 13, and 14 hingedly joined along score lines 15, 16, and 17 as shown. A glue flap 18 is hingedly joined to panel 11 along score line 19. Bottom closure and dust flaps 20, 21, 22, and 23 of conventional construction are hingedly connected along score lines 24, 25, 26, and 27 to side wall panels 11, 12, 13 and 14, respectively.

In especial accordance with the invention, top closure and dust flaps 28, 29, 30, and 31 are hingedly connected to side wall panels 11, 12, 13 and 14 along score lines 32, 33, 34, and 35. Dust flap 29 includes an arcuate recess 37 in its free edge portion and dust flap 31 includes a generally V-shaped recess 38 in its free edge portion. Flap 31 further includes a perforated score line 39 extending parallel to score line 35 and intermediate the latter and the free edge of flap 31. Also provided in flap 31 is an opening 40 having its base side coincident with cut score line 39, and confronting sides of equal length divergent from its base side toward score line 35 and interconnected by an arcuate side concavely facing the base side. Recess 38 and opening 40 thus have symmetry about a line extending through the apex of recess 38 and geneally perpendicular to score line 35.

In setting up the blank 10A into a carton 10, and as will be understood to advantage from FIGS. 2, 3, and 6, side walls 11, 12, 13 and 14 are folded into a rectangular sleeve about score lines 15, 16 and 17, and glue flap 18 is folded about score line 19 and glued, in conventional manner, to the inside surface of side wall 14. Dust flaps 21 and 23 are then folded about score line 25 and 27 over the open end of the sleeve, and closure flaps 20 and 22 are folded over the dust flaps and glued to one another in conventional manner to form an end closure or bottom wall of the carton 10.

The carton is then ready for receiving a bottle 41, which advantageously is held in place initially as seen in FIG. 6, and finally as seen in FIGS. 3, 4, and 5. As is seen to advantage in FIGS. 3 and 6, bottle 41 typically includes a base rim portion 42 that fits snugly within the carton side walls 11 to 14 and rests on the bottom carton wall. Side wall 43 of the bottle extends upwardly with a slight inward taper to a neck portion 44 including a screw cap 45 having a rotationally locking pump of conventional construction including a plunger 46 concentric with the cap and a dispensing nozzle 47 extending transversely of, for example at a substantially right angle to, the axis of the plunger. To lock the pump, plunger 46 is moved along with nozzle 47, to the retracted position shown and rotated to lock it in place; conversely, the pump is unlocked by rotating the nozzle and plunger and releasing same for its movement by a compression spring to extended operating position.

Due to the inward taper of the side wall 43 of the bottle, there will be a tendency for it to wobble as the carton is handled prior to opening by a user. To ensure against this, or the possibility of consequent rotational unlocking of the pump, bottle 41, with the pump in its rotationally locked, retracted position and the nozzle directed toward side wall 14, is placed in the carton, followed by folding dust flaps 29 and 31 over the carton's opening so that each of recesses 37 and 38 receive and frictionally engage generally opposite sides of plunger 46 of the bottle neck portion. At the same time, the tip of nozzle 47 is received within opening 40, as is facilitated by slightly folding flap 31 on perforated score 39. Closure flap 28 is then folded about score 32 over the top of nozzle 47, followed by folding closure flap 30 over flap 28 and adhering it thereto, in the position seen to advantage in FIG. 2. A tab 36 on closure flap 30 is left free for grasping and pulling to open the carton.

From the foregoing description, it will be appreciated that the invention achieves improved inexpensive means formed integrally with a carton, and cooperatively disposed as respects a contained bottle to prevent its movements relative to the carton.

While a preferred embodiment of the invention has been described, it will be appreciated that changes and modifications may be resorted to without departing from the scope of the appended claims.

I claim:

1. In a carton of the type having side and bottom walls, an opening opposite said bottom wall, and closure means for said opening, said carton being adapted to contain a bottle having a base portion to rest on said bottom wall and be engaged by said carton side wall, and a neck portion including a rotationally locking dispensing nozzle thereon, the improvement wherein said closure means comprises: a pair of dust flaps hingedly connected for closing inwardly of said opening on opposed, side wall portions of said carton, one of said dust flaps including a recess on a free edge portion opposite its hinged connection positioned and adapted to receive for frictional engagement by said one flap of one side of a bottle neck portion, and the other of said dust flaps including a recess on a free edge portion opposite its hinged connection positioned and adapted to receive for frictional engagement by said other flap of a side of said bottle neck portion opposite said one side, said other dust flap further including an opening between said recess therein and said hinged connection and positioned and adapted to receive said dispensing nozzle for frictional retention by said other flap of the latter in a rotationally locked position; and closure flap means positionable for closing to extend over said dust flaps in the recited disposition of the latter, said closure and said dust flaps being so cooperatively disposed in the recited closed positions thereof to prevent movements of said bottle tending to move said dispensing nozzle to unlock the same.

2. The carton of claim 1, wherein said other dust flap includes a fold line parallel to its hinged connection, and disposed intermediate its hinged connection and its free edge portion.

3. The carton of claim 2, wherein said opening is disposed between the recited hinged connection and said fold line, and is shaped and disposed to have a base side thereof substantially coincident with said fold line.

4. The carton of claim 3, wherein said opening has opposed sides of equal length extending divergently from said side coincident with said fold line toward the hinged connection of said other dust flap, said opposed sides interconnected by an arcuate side concavely facing said base side.

5. The carton of claim 1, 2, 3, or 4, wherein said neck portion includes a plunger on which said nozzle is carried, and comprises the recited bottle neck portion engaged by said dust flaps.

6. In combination, a carton and a bottle contained therein, said carton including side and bottom walls, an opening opposite the bottom wall, and closure means for said opening, said bottle having a base portion resting on said bottom wall and engaged by said carton side walls, a neck portion on said bottle including a rotationally locking dispensing nozzle projecting generally transversely of the axis of said neck portion, said closure means including a pair of dust flaps hingedly connected for closing inwardly of said opening and opposed side wall portions of said carton, one of said dust flaps including a recess on a free edge portion opposite its hinged connection positioned and adapted to receive, for frictional engagement by said one flap, one side of a bottle neck portion and the other of said dust flaps including a recess on a free edge portion opposite its hinged connection positioned and adapted to receive, for frictional engagement by said other flap, a side of said bottle neck portion opposite said one side, said other dust flap further including an opening between said recess therein and said hinged connection and positioned and adapted to receive said dispensing nozzle for frictional retention, by said other flap, in a rotationally locked position; and closure flap means positionable for closing to extend over said dust flaps in the recited disposition of the latter, said closure and said dust flaps being so cooperatively disposed to prevent movements of said bottle tending to move said nozzle to unlock the same.

7. The combination of claim 6, wherein said other dust flap includes a fold line parallel to its hinged connection and disposed intermediate its hinged connection and its free edge portions.

8. The combination of claim 7, wherein said opening is disposed between the recited hinged connection and said fold line, and is shaped and disposed to have a base side thereof substantially coincident with said fold line.

9. The combination of claim 8, wherein said opening has opposed sides of equal length extending divergently from said side coincident with said fold line toward the hinged connection of said other dust flap, said opposed sides interconnected by an arcuate side concavely facing said base side.

10. The combination claim 6, 7, 8, or 9, wherein said neck portion includes a plunger on which said nozzle is carried, and comprises the recited bottle neck portion engaged by said dust flaps.

* * * * *